US006948431B2

(12) United States Patent
Buck

(10) Patent No.: US 6,948,431 B2
(45) Date of Patent: Sep. 27, 2005

(54) METHOD FOR METERING DAMPENING SOLUTION WHEN PRINTING WITH AN OFFSET PRESS

(75) Inventor: Helmut Buck, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/866,156

(22) Filed: Jun. 10, 2004

(65) Prior Publication Data

US 2004/0250723 A1 Dec. 16, 2004

(30) Foreign Application Priority Data

Jun. 10, 2003 (DE) ..... 103 26 067

(51) Int. Cl.[7] ..... B41F 1/54; B41C 33/00; B41L 25/00

(52) U.S. Cl. ..... 101/484; 101/483; 101/148

(58) Field of Search ..... 101/484, 483, 101/148, 365, 350.1, 450.1, 363

(56) References Cited

U.S. PATENT DOCUMENTS

| | | | | |
|---|---|---|---|---|
| 3,053,181 A | | 9/1962 | Jorgensen | 101/483 |
| 3,433,155 A | * | 3/1969 | Norton | 101/148 |
| 3,744,414 A | * | 7/1973 | Krochert et al. | 101/148 |
| 4,230,056 A | | 10/1980 | Steinbach | 112/239 |
| 4,480,542 A | * | 11/1984 | Jeschke | 101/148 |
| 4,485,737 A | * | 12/1984 | Jeschke | 101/148 |
| 4,724,764 A | * | 2/1988 | MacPhee et al. | 101/451 |
| 4,981,077 A | * | 1/1991 | Alvarez | 101/148 |
| 4,991,502 A | * | 2/1991 | Akao | 101/148 |
| 5,050,994 A | | 9/1991 | Kipphan et al. | 356/445 |
| 5,090,316 A | | 2/1992 | Rodi et al. | 101/148 |
| 5,148,747 A | * | 9/1992 | Rodi et al. | 101/450.1 |
| 5,493,970 A | * | 2/1996 | Stoffler et al. | 101/363 |
| 5,520,113 A | * | 5/1996 | Joss et al. | 101/484 |
| 5,568,769 A | * | 10/1996 | Leuerer | 101/450.1 |
| 5,685,225 A | * | 11/1997 | Gensheimer et al. | 101/350.1 |
| 5,713,286 A | * | 2/1998 | Zorn | 101/450.1 |
| 5,784,960 A | * | 7/1998 | Gensheimer et al. | 101/352.09 |
| 5,845,576 A | * | 12/1998 | Junghans | 101/484 |
| 5,957,054 A | * | 9/1999 | Olawsky et al. | 101/483 |
| 6,119,594 A | * | 9/2000 | Kipphan et al. | 101/365 |
| 6,257,144 B1 | * | 7/2001 | Erhardt et al. | |

FOREIGN PATENT DOCUMENTS

| | | |
|---|---|---|
| DE | 38 30 732 A1 G | 3/1990 |
| DE | 39 12 811 A1 (D) | 10/1990 |
| DE | 43 28 864 A1 | 3/1995 |
| DE | 44 36 582 A1 | 4/1996 |
| JP | 10119235 A E | 5/1998 |

* cited by examiner

*Primary Examiner*—Andrew H. Hirshfeld
*Assistant Examiner*—Wasseem H. Hamdan
(74) *Attorney, Agent, or Firm*—Laurence A. Greenberg; Werner H. Stemer; Ralph E. Locher

(57) ABSTRACT

A novel damping control method permits improved reliability and higher accuracy when registering scumming during printing with an offset press. Signals are obtained by at least one sensor aimed at a revolving printing form cylinder. The signals are processed in a control device, actuating signals for a dampening solution metering device are produced, and the dampening solution is metered in accordance with the actuating signals by a dampening solution applicator roll in rolling contact with the surface of the printing form. The sensor provides a signal which reproduces an actual value of a width of an ink stripe that is induced by the process and located in the circumferential direction of the printing form cylinder. The stripe is formed in the printing image-free region of the printing form immediately after the trailing edge of the channel accommodating the edges of the printing form.

5 Claims, 3 Drawing Sheets

METHOD FOR METERING DAMPENING SOLUTION WHEN PRINTING WITH AN OFFSET PRESS

BACKGROUND OF THE INVENTION

Field of the Invention

The invention lies in the printing technology field. More specifically, the invention relates to a method for metering dampening solution when printing with an offset press. Sensor signals are obtained with at least one sensor aimed at a revolving printing form cylinder, the signals are processed in a control device and actuating signals for a dampening solution metering device are produced. The dampening solution is metered in accordance with the actuating signals by a dampening solution applicator roll in rolling contact with the surface of the printing form. The dampening solution applicator roll rolls over the printing form surface in image regions and image-free regions and also over a channel which exists in the axial direction on the circumferential surface of the printing form cylinder in order to accommodate the ends of the printing form in the latter.

When printing with a wet offset press, in order to achieve a proper print quality it is necessary to establish a balanced relationship between printing ink and dampening solution on the surface of a printing form and to keep it constant during the processing of a print job. The dampening solution is supplied by a damping unit. The dampening solution covers the non-image points of the printing form with a dampening solution film, so that no adhesion of printing ink occurs at these points. If too much dampening solution is supplied, dampening solution is forced into the ink-carrying image points and, in addition, dampening solution migrates into the inking unit and emulsification occurs there. In this case, what is known as the washing mark limit of the dampening solution is exceeded, so that what are known as snowflakes appear in the printed image on the printing material. Emulsification occurs on the printing plate. In the case of too little damping, printing ink also adheres to the non-image points. Here, what is known as scumming appears in the printed image. In order to obtain a good printing result and for economic reasons, operations are carried out with as little dampening solution as possible, close to the smearing limit. In the case of speed-compensating damping units, when the machine speed is increased, the supply of dampening solution is reduced, and is increased when the machine speed is slowed. In order to meter in dampening solution, methods are known in which the quantity of dampening solution in the printing ink is measured directly on a printing plate by sensors. The disadvantage is that the measurements of the quantity of dampening solution are unreliable because of the reflective capacity of the surface of a printing plate and because of the dependence on the color of the printing ink.

U.S. Pat. No. 5,050,994 and German published patent application DE 38 30 732 A1 describe a method of monitoring the supply of dampening solution in which non-image regions in the margins of image regions on a printing material are scanned using an optoelectric converter. The non-image regions must be located on rear margins of the image regions, as seen in the printing direction. In particular, non-image regions behind full-tone areas of a print control strip located transversely with respect to the printing direction are scanned. During scanning with the optoelectric converter, the lightness in the non-image region is evaluated. A dampening solution deficiency signal is derived if the lightness falls below a predefined amount. The registration of the start of scumming in the non-image regions via lightness measurements on the printing material is inaccurate, since fluctuations in the dampening solution manifest themselves only slightly in the lightness fluctuations.

In the method for detecting the smearing limit according to German published patent application DE 43 28 864 A1, outside the subject, an intrinsically ink-free surface zone on a printing form is depicted, being monitored for ink carrying by an optical sensor. The printing ink zone is located in the region of the print start of the printing form. In the case of a form cylinder having a clamping channel for a printing form, the surface zone, as viewed starting from the clamping channel of the form cylinder, is formed counter to the direction of rotation in the circumferential direction. The subject only follows at a distance from the surface zone. The solution according to this method is based on the finding that smearing initially occurs at the print start before it appears in the subject. By measuring the intensity of light reflected at the surface zone, the start of scumming can be registered and can be counteracted by controlling the dampening solution supply. This method has the disadvantages described above.

The method for detecting the smearing limit and dampening solution management in an offset press according to German published patent application DE 44 36 582 A1 eliminates the disadvantage of the unreliable damping measured values by evaluating the scatter of a large number of measured values from a sensor aimed at the marginal subject region of a printing form. Because the scatter value depends on the damping, the scatter values can be used in the dampening solution management. The method is slow and expensive in terms of computation.

SUMMARY OF THE INVENTION

It is accordingly an object of the invention to provide a method of metering dampening solution in a printing press, which overcomes the above-mentioned disadvantages of the heretofore-known devices and methods of this general type and which permits improved reliability and higher accuracy in registering scumming.

With the foregoing and other objects in view there is provided, in accordance with the invention, a method for metering dampening solution in an offset press having a printing form cylinder and a printing form with ends accommodated in a channel extending in an axial direction on a peripheral surface of the printing form cylinder. The method comprises the following method steps:

obtaining sensor signals with at least one sensor aimed at the printing form cylinder;

processing the sensor signals in a control device and generating actuating signals for a dampening solution metering device;

metering the dampening solution in accordance with the actuating signals by a dampening solution applicator roll in rolling contact with a surface of the printing form, the dampening solution applicator roll rolling over the surface of the printing form in image regions and in image-free regions thereof and over the channel in the printing form cylinder;

utilizing the at least one sensor to obtain a signal representing an actual value of a width of an ink stripe in a circumferential direction of the printing form cylinder, and formed in an image-free region of the printing form immediately following a trailing edge of the channel.

In accordance with an added feature of the invention, the signals are obtained with the sensor(s) from a marginal region of the printing form.

In accordance with an additional feature of the invention, a desired value for the ink stripe width is predefined and, when the actual value exceeds the desired value, a quantity of dampening solution supplied to the printing form is increased until the actual value falls below the desired value.

In accordance with another feature of the invention, the method includes obtaining rotational position signals of the printing form cylinder with a rotary encoder, processing the rotational position signals together with the signals from the at least one sensor, defining a rotational angle window, and evaluating the signals from the sensor within the rotational angle window with the control device.

In accordance with a concomitant feature of the invention, the signals from the sensor resulting from the trailing channel edge are used to stimulate the sensor.

The invention is based on the finding that the width of an ink stripe which is formed in a printing image-free region of a printing form immediately after the trailing edge of a channel in the printing form cylinder changes considerably when the smearing limit is reached or exceeded as a result of dampening solution supply. In a printing unit of a wet offset press, ink applicator rolls and dampening solution applicator rolls are set under pressure against a printing form of a printing form cylinder. If the printing form cylinder contains a channel, in which the ends of a printing form are held, then, when the channel is passed, the pressure on the rolls is canceled and, upon emergence from the channel region, the pressure is built up abruptly again. In the process, a strip-like deposition of ink is produced in the print-free region of the printing form immediately after the channel. If a printing form cylinder bears a plurality of printing forms and has a plurality of channels, then the aforesaid ink stripes are produced behind each channel. The growth in the width of an ink stripe can be monitored by a sensor during printing. Since, because of maximum pressure, the width growth is manifested particularly clearly in the marginal region of a printing form, it is advantageous to aim a sensor at the printing form in the marginal region. In order to increase the accuracy when measuring the ink stripe width, in each case one sensor can be arranged in the two marginal regions. During rotation of a printing form cylinder, an ink stripe can be detected immediately after the channel without additional position information, because of its unambiguous position. In this case, a signal resulting from the channel edge can be used to stimulate a sensor. If the rotational movement of a printing form cylinder is registered by a rotary encoder, then a rotational angle window can be defined in which the signals from the sensor are evaluated in a control device.

A desired value as a threshold value for the ink stripe width can be predefined or learned. If the threshold value is exceeded, then the quantity of dampening solution is increased immediately, until an ink stripe width which was present before the abrupt width growth is reached again.

Other features which are considered as characteristic for the invention are set forth in the appended claims.

Although the invention is illustrated and described herein as embodied in a method for metering dampening solution when printing with an offset press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
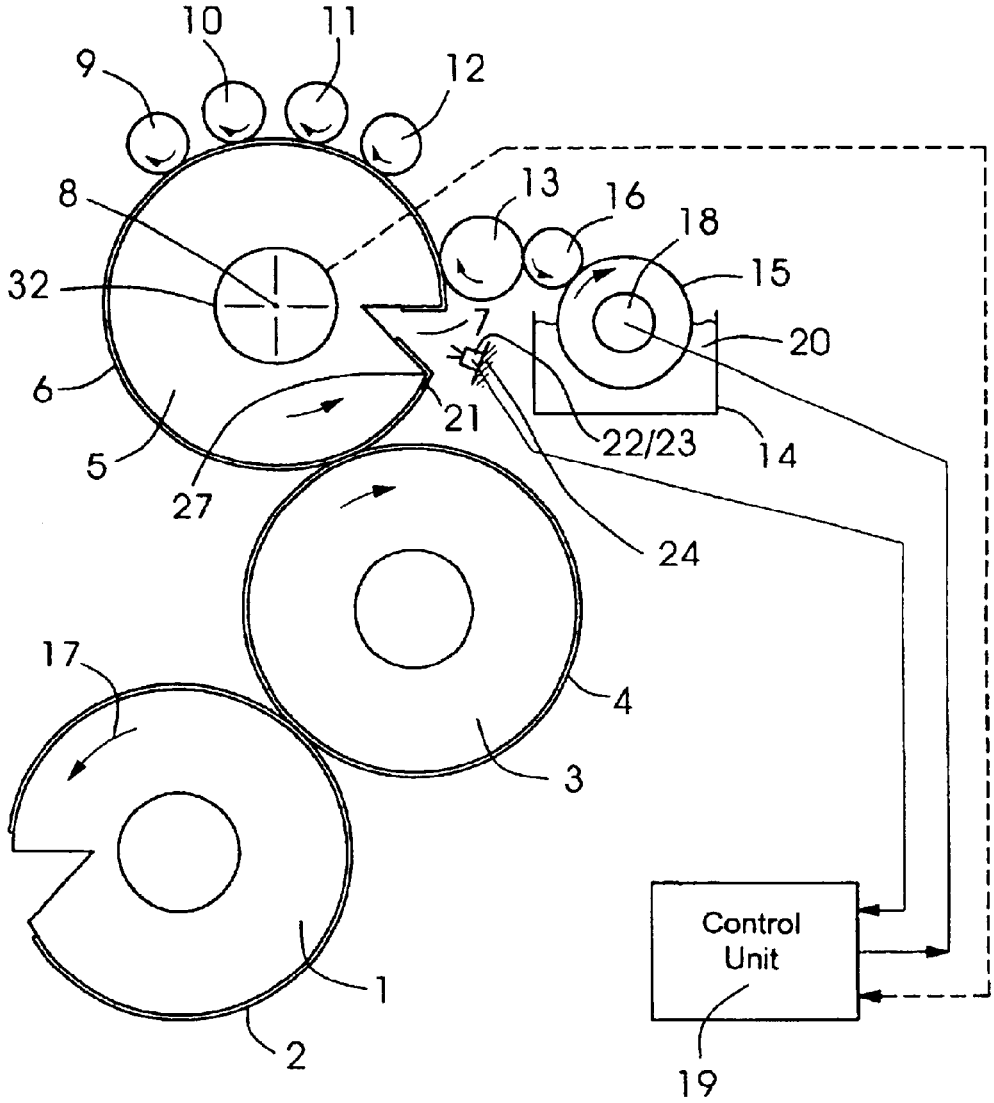
FIG. 1 is a schematic view of an offset printing unit.

Referring now to the figures of the drawing in detail and first, particularly, to FIG. 1 thereof, there is shown a printing unit with an impression cylinder 1 having a sheet 2 fixed thereon. A transfer cylinder 3 has a resilient covering 4, and a plate cylinder 5 carries a printing plate 6. The ends of the printing plate 6 are fixed in a channel 7. The channel 7 runs parallel to the axis of rotation 8 of the plate cylinder 5. During printing, ink applicator rolls 9–12 and a dampening solution applicator roll 13 are set against the plate cylinder 5, that is, against the printing plate 6. The ink applicator rolls 9–12 are a constituent part of an inking unit. The dampening solution applicator roll 13 belongs to a damping unit having a dampening solution storage container 14, a dip roll 15 and a metering roll 16, which is in rolling contact with the dip roll 15 and the dampening solution applicator roll 13. The impression cylinder 1, the transfer cylinder 3, the plate cylinder 5 and the ink applicator rolls 9–12 are connected to one another via a common gear train.

During printing, the cylinders 3, 5 and the rolls 9–13, 15–16 rotate in the directions indicated by arrows 17. The dip roll 15 is coupled to a separate motor 18. The motor 18 is connected to a control device or control unit 19. The control device 19 prescribes the rotational speed of the dip roll 15. The faster the dip roll 15 is rotated, the more dampening solution 20 is scooped out of the dampening solution storage container 14 and transferred to the printing plate 6 via the metering roll 16 and the dampening solution applicator roll 13.

Figure 2:
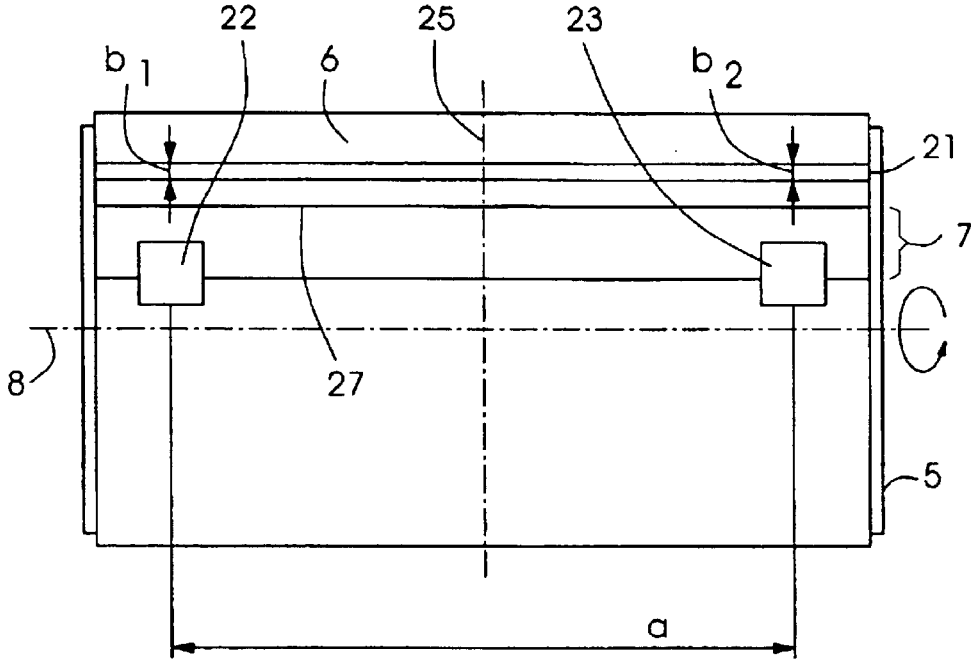
FIG. 2 is an elevational view showing the position of sensors in the marginal regions of a printing form.

In order to detect the widths $b_1$, $b_2$ of an ink stripe 21 in the circumferential direction of the plate cylinder 5, two optical sensors 22, 23 are arranged fixed to the frame 24 of the press. As FIG. 2 shows in more detail, with an orthogonal viewing direction towards the axis of rotation 8, the sensors 22, 23 are at a distance a symmetrically with respect to a center line 25 of the printing plate 6. The sensors 22, 23 receive measuring light from the surface of the printing plate and are connected to the control device 19. The spectral sensitivity of the sensors 22, 23 is designed specifically for the color of the printing ink in the printing unit.

Figure 4:
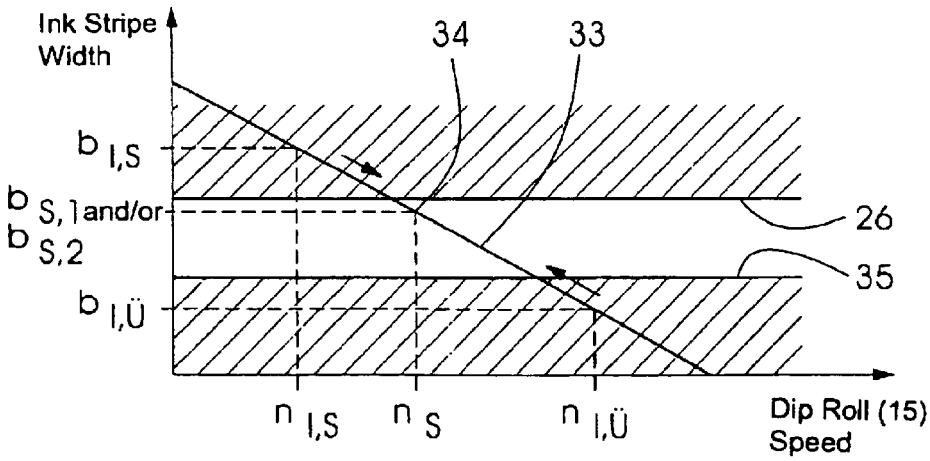
FIG. 4 is a graph illustrating the dependence of the ink stripe width on the quantity of dampening solution supplied.
Figure 3A:
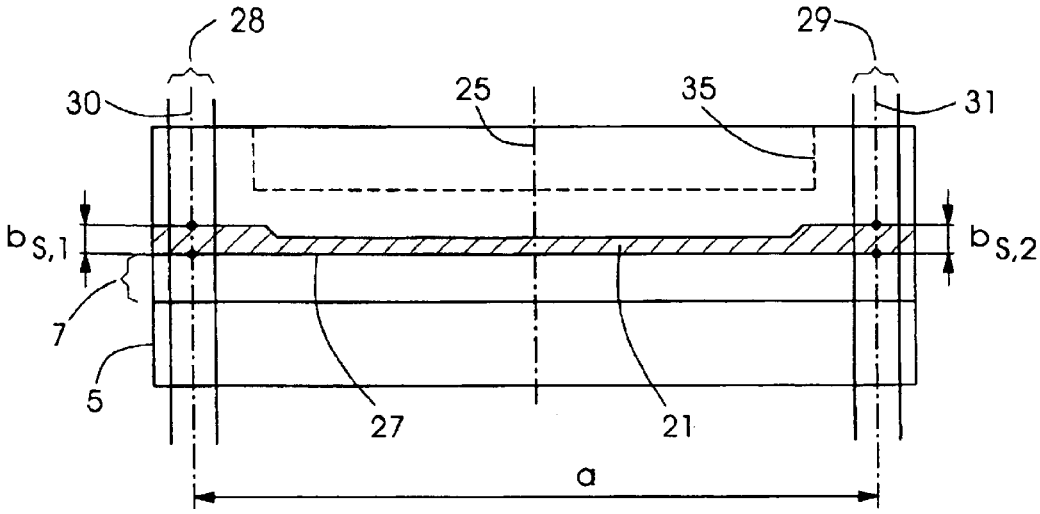
FIGS. 3A and 3B are schematic views with ink stripes, showing a correct and an incorrect supply of dampening solution, respectively.
Figure 3B:
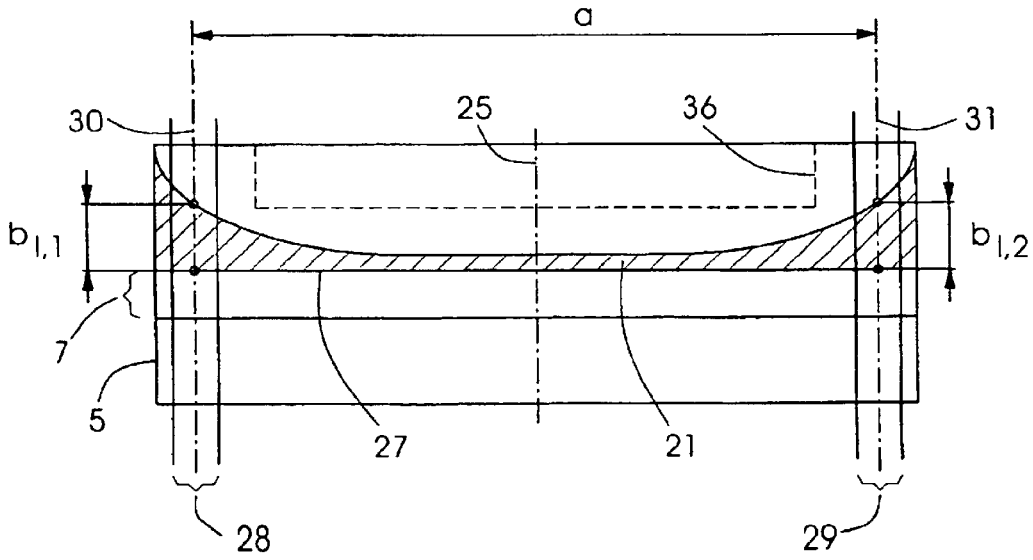

FIGS. 3A and 3B show in more detail the behavior or an ink stripe 21 in the case of correct and incorrect supply of dampening solution. If, as shown in FIG. 1 and FIG. 4, the motor 18 is set by the control device 19 to a rotational speed ns, then a supply of dampening solution close to the smearing limit 26 is established. As the dampening solution applicator roll 13 and the ink applicator rolls 9–12 roll over the edge 27 of the channel 7, an ink stripe 21 of width $b_{S,1}$ and $b_{S,2}$, respectively, is produced in the marginal regions 28, 29 of the printing plate 6. During scanning along the tracks 30, 31, signal edges, whose spacing is evaluated in the control device 19, are produced at the output from the sensors 22, 23. If signals from a rotary encoder 32 for the rotational angle of the plate cylinder 5 are simultaneously present in the control device 19, then these signals can be used for a measurement of the widths $b_{S,1}$, $b_{S,2}$ which is independent of the rotational speed. The values of the widths $b_{S,1}$ and $b_{S,2}$ are stored as desired values in the control device 19 in the case of a correct supply of dampening solution.

If, during printing, for various reasons too little dampening solution 20 is available on the printing plates 6, then the ink stripe width b increases considerably and/or abruptly. This case is illustrated in FIG. 3B and FIG. 4. The evaluation of the signals from the sensors 22, 23 in the control device 19 gives the actual values $b_{I,1}$, $b_{I,2}$ of the ink stripe width in the marginal regions 28, 29. As emerges from FIG. 4, the desired values $b_{S,1}$ and $b_{S,2}$ at the optimum working point are exceeded. The smearing limit 26 is exceeded and a working point, for example $n_{I,S}/b_{I,S}$, is reached. This drifting over the smearing limit 26 is counteracted by increasing the rotational speed n of the dip roll 15. In the graph according to FIG. 4, the ink stripe width b again moves on the working line 33 in the direction of the optimum working point 34 with the correct ink stripe width $b_{S,1}$ and $b_{S,2}$.

If the ink stripe width approaches zero and, for example, the quantity of dampening solution at the working point ($n_{I,\bar{U}}/b_{I,\bar{U}}$) is too high, the limit 35 for overdamping will be undershot. In this case, counteraction is taken by reducing the rotational speed n of the dip roll 15. In the graph according to FIG. 4, the ink stripe width b moves on the working line 33 in the direction of the optimum working point 34.

In any case, the ink stripe 21 on the printing plate 6 is located outside the subject 36. The invention can be applied both in sheet-fed presses and in web-fed presses.

This application claims the priority, under 35 U.S.C. § 119, of German patent application No. 103 26 067.6, filed Jun. 10, 2003; the entire disclosure of the prior application is herewith incorporated by reference.

I claim:

1. A method for metering dampening solution in an offset press having a printing form cylinder and a printing form with ends accommodated in a channel extending in an axial direction on a peripheral surface of the printing form cylinder, the method which comprises:

obtaining sensor signals with at least one sensor aimed at the printing form cylinder;

processing the sensor signals in a control device and generating actuating signals for a dampening solution metering device;

metering the dampening solution in accordance with the actuating signals by a dampening solution applicator roll in rolling contact with a surface of the printing form, the dampening solution applicator roll rolling over the surface of the printing form in image regions and in image-free regions thereof and over the channel in the printing form cylinder;

utilizing the at least one sensor to obtain a signal representing an actual value of a width of an ink stripe in a circumferential direction of the printing form cylinder, and formed in an image-free region of the printing form immediately following a trailing edge of the channel.

2. The method according to claim 1, which comprises obtaining the signals with the at least one sensor from marginal region of the printing form.

3. The method according to claim 1, which comprises predefining a desired value for the ink stripe width, and, when the actual value exceeds the desired value, increasing a quantity of dampening solution supplied to the printing form until the actual value falls below the desired value.

4. The method according to claim 1, which comprises using the signals from the sensor resulting from the trailing channel edge to stimulate the sensor.

5. A method for metering dampening solution in an offset press having a printing form cylinder and a printing form with ends accommodated in a channel formed in a peripheral surface of the printing form cylinder, the method which comprises:

applying dampening solution with a dampening solution applicator roll in rolling contact with a surface of the printing form, the dampening solution applicator roll rolling over the surface of the printing form in image regions and in image-free regions thereof and over the channel in the printing form cylinder;

obtaining a sensor signal with at least one sensor aimed at the printing form cylinder, the sensor signal representing an actual value of a width, in a circumferential direction of the printing form cylinder, of an ink stripe formed in an image-free region of the printing form immediately following a trailing edge of the channel;

processing the sensor signal in a control device and generating an actuating signal as a function of the width of the ink stripe; and metering the dampening solution with the dampening solution applicator roll in accordance with the actuating signal.

* * * * *